United States Patent [19]

Rosenthal

[11] Patent Number: 5,042,351

[45] Date of Patent: Aug. 27, 1991

[54] FEEDING APPARATUS FOR A MACHINE FOR FEEDING AND CUTTING SHEET MATERIALS

[75] Inventor: Ben J. Rosenthal, Wilmette, Ill.

[73] Assignee: Rosenthal Manufacturing Company, Inc., Chicago, Ill.

[21] Appl. No.: 358,823

[22] Filed: May 30, 1989

[51] Int. Cl.[5] ..... B26D 7/00

[52] U.S. Cl. ..... 83/649; 83/24; 83/56; 83/402

[58] Field of Search ..... 226/135; 83/22, 24, 83/56, 169, 402, 436, 649, 98, 171; 53/389

[56] References Cited

U.S. PATENT DOCUMENTS

| | | | |
|---|---|---|---|
| 2,668,705 | 2/1954 | Rosenthal | 226/135 |
| 3,177,748 | 4/1965 | Rosenthal | 83/171 |
| 3,299,756 | 1/1967 | Rosenthal | 83/98 |
| 3,760,669 | 9/1973 | Rosenthal et al. | 83/63 |
| 4,781,336 | 11/1988 | Rosenthal et al. | 242/58.6 |

*Primary Examiner*—W. Donald Bray

*Attorney, Agent, or Firm*—Allegretti & Witcoff, LTD.

[57] ABSTRACT

The invention provides an improved feeding apparatus for transporting sheet material through a sheeting machine using an airstream. This feeding apparatus includes a modified pressure roll and an airstream that is circulated around the pressure roll, through passages in the surface of the pressure roll, and across the surface of the sheet material. The passage of the airstream over the sheet material creates a lifting force suspending the material above the interior surfaces of the machine to reduce or eliminate snags, snarls and blockages of the sheet material within the machine.

14 Claims, 2 Drawing Sheets

FEEDING APPARATUS FOR A MACHINE FOR FEEDING AND CUTTING SHEET MATERIALS

FIELD OF THE INVENTION

This invention relates to sheeting machines, that is, machines for feeding and cutting sheet materials. More particularly, the invention relates to a modified and improved feeding means for transporting such sheet materials through a sheeting machine to deliver cut sheet material to the machine operator efficiently and with minimal waste of material and labor.

DESCRIPTION OF THE PRIOR ART

Sheeting machines typically are provided with sheet material drawn from a supply source (normally a supply roll) by a feed roll within the sheeting machine. Such sheet materials may include, for example, polymeric films of polyvinylchloride (PVC), polyethylene or other flexible polymeric materials, paper webs, foils, laminated composite films or webs, and other such flexible materials. The material is advanced by movement between the feed roll and a pressure roll to a cutting mechanism. The pressure roll holds the sheet material against the feed roll and both rolls are usually provided with a continuous surface (often of rubber or other such materials) to grip the sheet material so that it can be advanced through the machine.

At the cutting area, the material is sheared to a predetermined length by a combination of fixed and movable blades. The cut material then moves through an exit opening in the machine to a table top for stacking and handling by the machine operator. Examples of such machines can be found in Rosenthal, U.S. Pat. No. 2,668,705; Rosenthal, U.S. Pat. No. 3,299,756; Rosenthal et al., U.S. Pat. No. 3,760,669; and Rosenthal et al., U.S. Pat. No. 4,781,336.

The sheet materials in such machines, however, tend to frictionally contact the interior surfaces of the sheeting machine as they move through the machine. As a result, the material frequently catches, snags and bunches within the machine causing blockages or snarls that damage the sheet material and disrupt further operation of the machine. Consequently, the machine operator is often forced to stop the machine, clear the blockage, and remove the damaged or snagged material.

Such difficulties with the prior art sheeting machines frequently result in significant waste and inefficiencies in both material and labor. This is particularly a problem when the sheeting material is of a relatively lightweight material such as flexible PVC film (2 to 20 mils thick) or other such lightweight polymeric film materials. Such films are easily damaged and frequently catch or snag in sheeting machines unless they receive special handling by the machine operator.

One attempt to improve the operation of the prior sheeting machines was to install a transverse vent to direct a column of air against the underside of sheet material moving through the machine. This air column acted to provide a cushion of air beneath a portion of the material to reduce contact between that portion of the sheet material and the interior of the machine.

This design which directed an air column beneath the sheet material did not necessarily support the remainder of the material, including the material's peripheral edges and trailing portions. The vent design, in addition, failed to support the sheet material at a significant distance from the vent area. As a result, the unsupported portions of the sheet material continued to stick, snag and lodge within those sheeting machines.

The present invention overcomes these disadvantages by directing an airstream above the surface of sheet material within the sheeting machine to produce a lifting force along the entire surface of the sheet material. Thus, the material is suspended above the interior surfaces of the sheeting machine to greatly improve the efficiency of the machine by reducing blockages and sticking of the sheet material within the machine.

OBJECTS OF THE INVENTION

It is therefore an object of this invention to provide an improved apparatus for transporting sheet material through a sheeting machine.

It is a specific object of this invention to provide an apparatus for reducing the possibility of snags, tears, bunching, snarls or blockages in sheet material as it is transported through a sheeting machine.

It is another object of the invention to provide an apparatus that increases the efficiencies associated with feeding sheet materials through sheeting machines.

It is another object of the invention to provide an apparatus for creating a lifting force on sheet material within a sheeting machine to suspend the sheet material above the exterior surfaces of the machine.

Other objects, advantages and features of the present invention will become apparent upon reading the following detailed description and appended claims, and upon reference to the accompanying drawings.

SUMMARY OF THE INVENTION

The invention provides an improved feeding means for transporting sheet material through a sheeting machine using an airstream. This feeding means includes a modified pressure roll and an airstream that is circulated around the pressure roll, through passages in the surface of the pressure roll, and across the surface of the sheet material. The passage of the airstream over the sheet material creates a lifting force suspending the material above the interior surfaces of the machine to reduce or eliminate snags, snarls and blockages of the sheet material within the machine.

One embodiment of the invention is provided with sheet material from a supply roll mounted on an unwind shaft. The sheet material is drawn between rotating feed and pressure rolls where the lower surface of the sheet material is engaged by the feed roll to urge the material through the sheeting machine. The upper surface of the sheet material is engaged by the pressure roll to hold the sheet material against the feed roll.

The feed and pressure rolls are enclosed within a roll cover. This roll cover forms an enclosure or air duct above the pressure roll to direct an airstream against and around the pressure roll. The airstream is generated by an air source, such as a fan or blower, opening into the air duct.

The pressure roll is modified to include a series of annular pressure surfaces or pressure rings evenly spaced across its surface. These pressure rings form air passages directing the airstream around the pressure roll and along the upper surface of the sheet material. The movement of this airstream above the sheet material creates a lifting force suspending the material above the internal surfaces of the machine.

The sheeting material is propelled forward a predetermined length by the feed and pressure rolls to a cutting area where it is sheared by cutting blades. The cut sheet material is removed from the machine through an exit opening where the airstream is vented and the sheet material is deposited on a table surface for stacking or further handling.

The machine may also be provided with baffles, directing or controlling surfaces, vents or other such means to influence the flow of the airstream from the air source to the exit opening. The flow rate of the airstream over the sheet material, in addition, may be adjusted to maximize the lifting effect produced by the invention.

Thus, the present invention provides a simple, efficient and cost effective design for increasing the efficiency of sheeting machines. The invention overcomes the drawbacks of the prior art systems, including those using other air source arrangements. The invention, in addition, allows the use of lighter weight materials in sheeting machines. For example, sheeting machines capable of handling only PVC sheet materials with a thickness or caliper of 4 mils may easily accommodate 2 mil PVC materials when equipped with the invention.

BRIEF DESCRIPTION OF THE DRAWINGS

For a more complete understanding of this invention, reference should be made to the embodiments illustrated in greater detail in the accompanying drawings and described below by way of examples of the invention. In the drawings.

Figure 1:
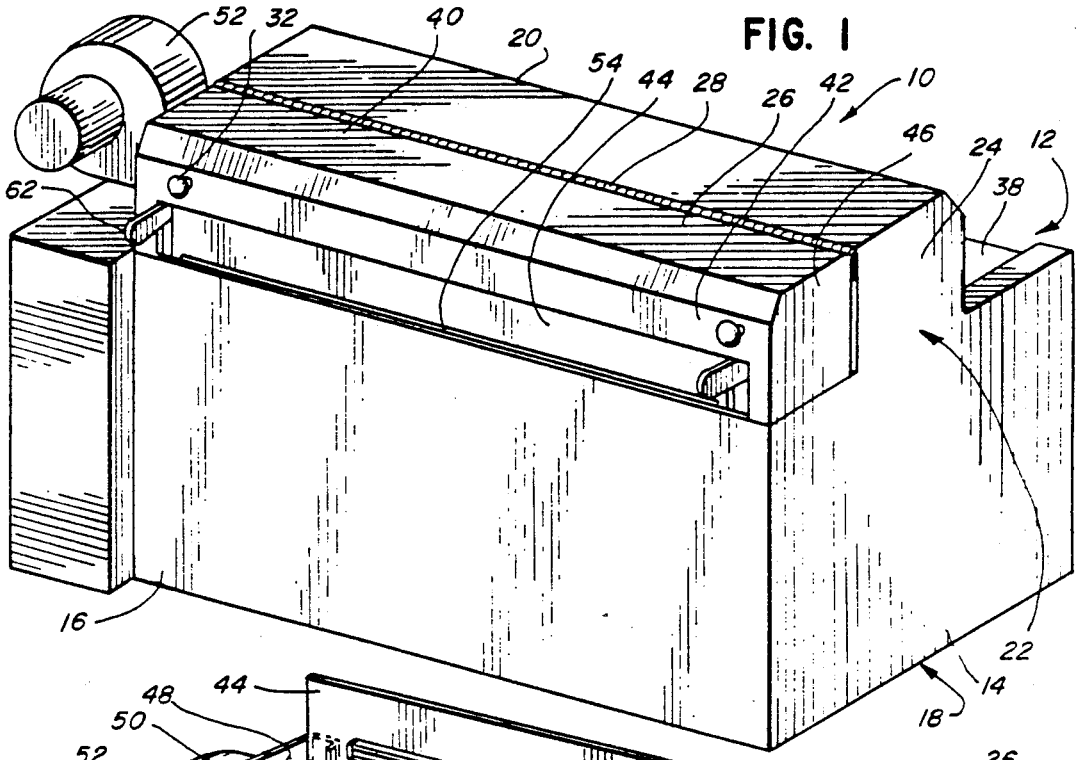
FIG. 1 is a rear perspective view of an improved sheeting machine incorporating an embodiment of the present invention.

It should be understood that the drawings are not necessarily to scale and that an embodiment is sometimes illustrated in part by fragmentary views. In certain instances, details of the actual structure which are not necessary for the understanding of the present invention may have been omitted. It should be understood, of course, that the invention is not necessarily limited to the particular embodiments illustrated herein.

DETAILED DESCRIPTION OF THE DRAWINGS

Turning now to the drawings, FIGS. 1 through 4 show a sheeting machine 10 incorporating a preferred embodiment of the invention. The machine is provided with a support frame having a front panel 12, side panels 14, a back panel 16, a bottom 18 and a top 20.

Figure 2:
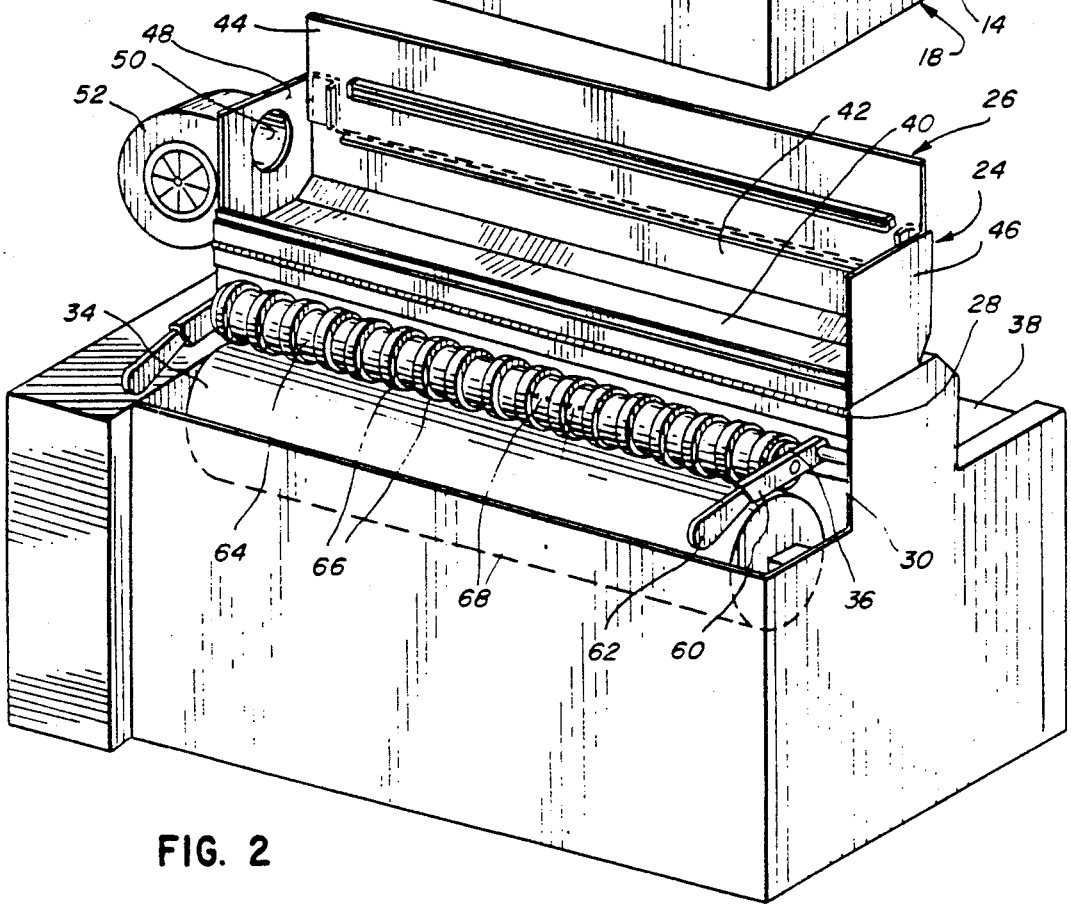
FIG. 2 is a rear perspective view of the apparatus of FIG. 1 with the roll cover in a partially open service position.
Figure 4:
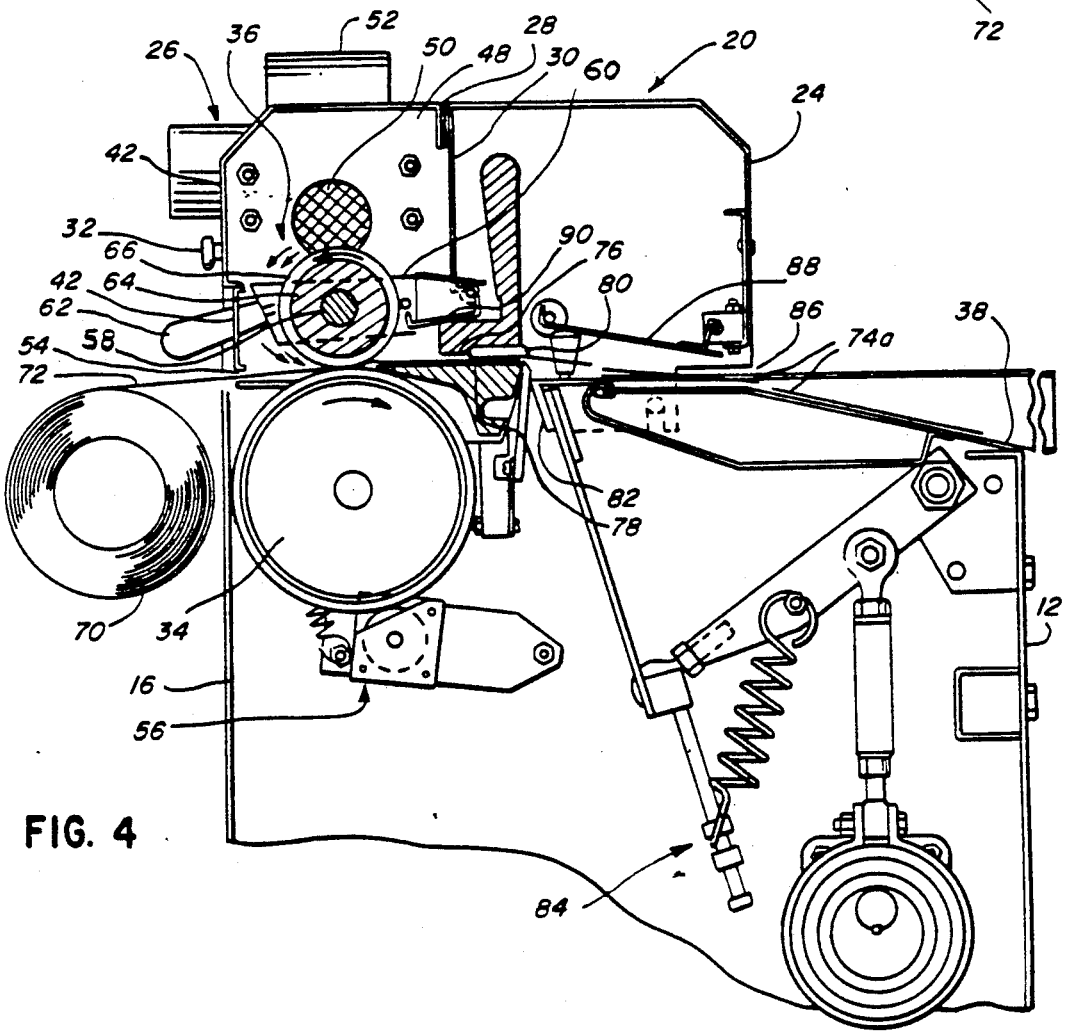
FIG. 4 is a sectional side view of a portion of the apparatus of FIG. 1 illustrating a preferred embodiment of the invention.

The machine top 20 is provided with an enclosure 22 having a hood portion 24 and a roll cover 26 attached to a hinge member 28 mounted on the wall member 30 (see FIGS. 2 and 4). The roll cover may be lifted with knobs 32 to an open position (as shown in FIG. 2) exposing a feed roll 34 and a pressure roll 36 for servicing or inspection. The machine top 20 may also be provided with a handling or receiving table 38.

The roll cover 26 is provided with a top panel 40, a rear panel 42 with a detachable skirt 44, a first side panel 46, and a second side panel 48 provided with a port 50. An air source 52, such as a fan, blower or the like, is attached to the second side panel 48 to introduce an airstream into the roll cover thorough the port 50.

When the roll cover is in its closed position (see FIG. 1), the top panel 40, the rear panel 42, the skirt 44, the side panels 46 and 48, and the wall member 30 form an enclosure or air duct to direct the airstream produced by the air source 52 against and around the pressure roll 36. The skirt 44 and rear panel 16 also form an access opening 54 (see FIGS. 1 and 4) to allow the supply of sheet material to the feed roll 34 and pressure roll 36 with minimal airstream leakage. The skirt may be fixed or it may be adjustable to vary the size of the access opening 54 to optimize the operation of the sheeting machine.

Additional permanent or adjustable baffles, air directing surfaces, vanes, vents, conduits or the like may also be employed within the roll cover (and within the air source) to influence the direction, volume and intensity of the airstream within the machine. The air source, in addition, may be provided with speed or volume controls to vary the volume and velocity of the airstream. Thus, the characteristics of the airstream may be modified to obtain the optimum conditions for the efficient operation of the sheeting machine in view of the particular sheet materials used and the needs of the operator.

As shown in FIGS. 2 and 4, the feed roll 34 typically is driven and controlled by a drive apparatus 56 such as, for example, that discussed in Rosenthal et al., U.S. Pat. No. 3,760,669 which is incorporated herein by reference. The feed roll 34 is provided with a continuous smooth surface extending at least across the width of the sheet material. This surface is usually of a smooth, uniform rubber material or rubber-like material, but may also be of plastic, nylon, metal, coated or covered metals or plastics, or similar materials. The surface of the drive roll may also incorporate other features, such as added gripping configurations or textures, or gripping coatings or cover layers.

Figure 3:
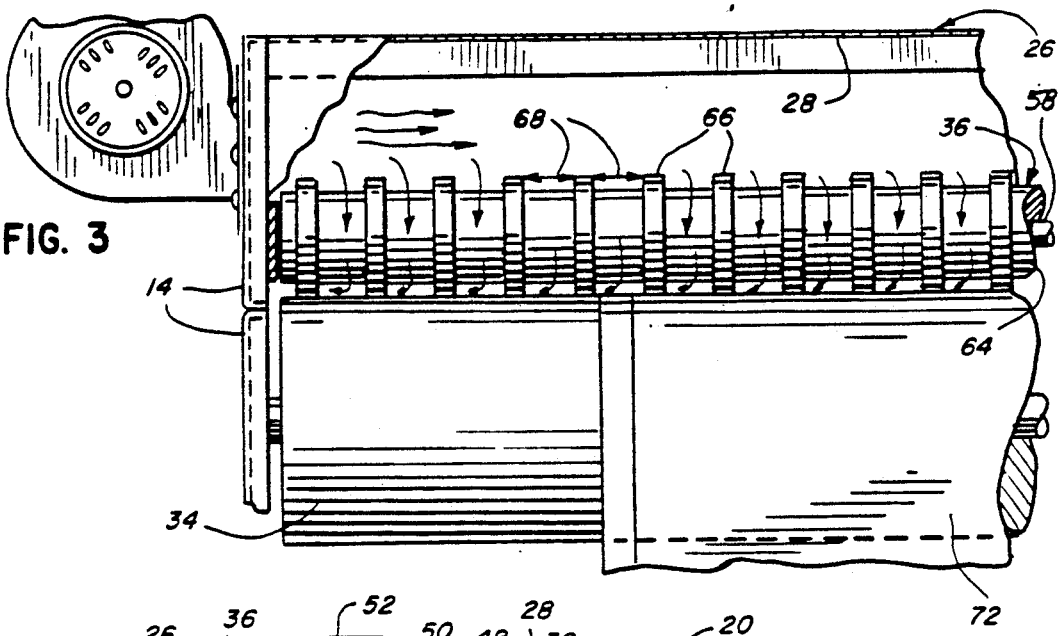
FIG. 3 is a rear view of the apparatus of FIG. 1 illustrating the pressure and feed rollers of the apparatus.

As shown in FIGS. 2 and 3, the pressure roll 36 is mounted on a shaft 58 attached to pivoting support arms 60 which are provided with lift handles 62. The pressure roll 36 comprises a cylindrical center roll 64 with a series of annular pressure members or pressure rings 66 spaced across the length of the roll. These pressure rings 66 may be composed of a variety of materials, including rubbers, plastics, nylons, foamed polymers or rubbers, metals, composites or combinations of such materials. The pressure rings may be hollow or solid throughout all or a part of their thickness. They may also be provided with gripping surface configurations, rubber or plastic gripping covers or coatings, and other such means to improve their handling characteristics and overall performance.

In the preferred embodiment, the pressure rings 66 have a generally cylindrical shape with side walls and an outer engagement surface spaced from the center roll 62, where the width of each pressure ring across its engagement surface is greater than its diameter. Other pressure ring dimensions and configurations may also be used depending on the particular application. The pressure rings may be removably fastened to the center roll 64 so that the pressure roll 36 may be easily reconditioned or to individually replace worn or damaged pressure rings. Alternatively, the pressure rings may be integrally formed with the center roll 64 or may be permanently affixed to the center roll and may be provided with replaceable covers or coatings to extend their life.

In the preferred embodiment, the pressure rings 66 are evenly spaced along the width of the pressure roll 36. They may also be spaced in an irregular manner or in a regular or irregular pattern. The number of pressure rings and the distance between the rings depends on the spacing pattern used, the particular sheeting machine and sheet materials used, as well as the actual processing conditions. Similarly, the distance between the outer engagement surfaces of the pressure rings and the center roll 64 may be varied depending on the particular application.

The side walls of the pressure rings 66 and the surface of the center roll 64 form air passages 68 along, or in, the surface of the pressure roll 36. These air passages permit the free circulation of the above-mentioned airstream around the pressure roll 36 and past the feed roll. The pressure roll may be further provided with vanes, protrusions, or control surfaces to further direct or influence the movement of the airstream.

As shown in FIG. 4, the sheeting machine 10 is provided with a supply roll of sheet material mounted on an unwind assembly such as that discussed in the Rosenthal et al. '669 patent and Rosenthal et al. U.S. Pat. No. 4,781,336 which is also incorporated herein by reference. As shown in FIGS. 3 and 4, the supply roll 70 dispenses sheet material 72 to the sheeting machine 10 through the access opening 54.

The sheet material used in the preferred embodiment is usually of a lightweight film or web, including films of polyvinylchloride ("PVC"), polyethylene and other polymeric materials, paper or foil webs, laminated webs or films, and other such products, although other types of materials may be used as well. Such materials may have a variety of thicknesses or calipers including, for example, calipers from 2 to 20 mils.

As shown in FIGS. 3 and 4, the sheet material 74 is fed through the access opening 54 to the feed roll 34 and pressure roll 36. The feed roll 34 is rotated by the drive apparatus 56 to engage one surface of the sheet material 74. The pressure roll 36, rotating in a direction opposite the feed roll 34, engages the opposite surface of the sheet material with the pressure rings 66 to hold the material against the drive roll and, with the feed roll, to propel the sheet material through the machine.

The sheet material 74 is contacted by the previously discussed airstream circulating around the pressure roll 36 as it enters the access opening 54. The duct configuration of the roll cover 26 and pressure roll air passages 68, as well as the rotation of the pressure roll 36, direct the airstream against and across the upper surface of the sheet material. The airstream, passing through the air passages 68 in the pressure roll, continues above the sheet material as the material is engaged and propelled forward by the feed roll. Depending on the nature and speed of the pressure roll, the rotation of the pressure roll may augment the velocity of the airstream. As shown in FIG. 4, the movement of the airstream over the sheet material creates a lifting force on the sheet material which suspends and supports the material above the interior surfaces of the machine.

In the preferred embodiment, the sheeting material advances through a paper chute having a lower surface 76 and an upper surface to 78 to a cutting assembly disposed within the hood 24. The upper and lower surface of the paper chute may be spaced to constrict and accelerate the flow of the airstream over the upper surface of the sheet material to enhance the lifting force of the airstream. The paper chute may also have other configurations depending on the particular application.

The cutting assembly includes a fixed cutting blade 80 attached to the upper surface 76 of the paper chute and a movable cutting blade 82 connected to a cammed drive apparatus 84. Such cutting assemblies are discussed in the above-mentioned Rosenthal et al. '699 and '336 patents.

The sheet material is sheared to predetermined dimensions by stopping the feed roll after a length of material has been fed and activating the cutting mechanism. The cut sheets 74*a* move through an exit opening 86 to, in the preferred embodiment, the, handling table 38 formed on the top 20 of the machine. The remaining airstream is simultaneously vented through the exit opening 86. While the lifting force induced by the airstream may be somewhat reduced by the loss of a portion of the airstream to the space within the hood 24 or by the slicing movement of the movable blade 82 through the airstream during the cutting step, the velocity and volume of the airstream may be adjusted as discussed above to provide adequate lifting force throughout the sheet material's path through the machine.

The shape of certain portions of the sheeting machine such as the hood 24, a knife flapper apparatus 88 or choke flap 90 also may be adjusted to maximize the lifting force of the airstream. Similarly, other baffles, vanes, air directing surfaces, or slots, vents and the like may be used to supplement or enhance the operation of the airstream throughout the machine.

Similarly, should it be desirable to reverse the feed and pressure rolls, that is to place the feed roll above the pressure roll, then the feed roll may also be provided with air passages to direct the airstream above the sheet material. These air passages may be formed within the feed roll by pressure rings such as those discussed above in connection with the pressure roll.

Thus, the apparatus discussed above provides a lifting force suspending and supporting sheet material above the interior surfaces of a feeding and cutting machine. The frictional contact between the sheet material and these interior surfaces is greatly reduced, which significantly limits, if not eliminates, the possibility of snags, snarls, bunching, tearing or other damage or blockage of the sheet material within the sheeting machine.

Therefore, the present invention increases the efficient use of materials, manpower and time associated with the sheeting machines. Moreover, much lighter weight materials may be used in sheeting machines equipped with the invention than previously thought economically feasible. For example, sheeting machines capable of handling only PVC films with a 4 mil caliper may be used with 2 mil film materials.

Furthermore, the invention produces a sufficiently uniform lifting force on the sheet material to prevent undue contact between the sheet material and the interior surfaces of the machine, particularly in the peripheral areas of the sheet material. Thus, the invention provides greater efficiencies than prior art systems which use a vent to direct air below the sheet material. The invention also delivers the cut sheet material to the handling area with minimal guidance by the operator for easy handling and stacking.

While the invention has been described by reference to certain specific descriptions and examples which illustrate preferred materials, configurations and conditions, it is understood that the invention is not limited thereto. Rather, all alternatives, modifications and equivalents within the scope and spirit of the invention so described are considered to be within the scope of the appended claims.

What is claimed is:

1. An apparatus for feeding and cutting predetermined amounts of sheet material comprising:

a supply source of sheet material;

feeding means for receiving the sheet material from the supply source;

air source means for generating a moving stream of air operatively disposed above the feeding means;

directing means for guiding the stream of air above the sheet material, and cutting means for cutting a predetermined amount of the sheet material.

2. The improved apparatus for feeding and cutting sheet material of claim 1 wherein the feeding means comprises a rotating feed roll and a rotating pressure roll in operative relation above the feed roll allowing passage of the sheet material therebetween.

3. The improved apparatus for feeding and cutting sheet material of claim 2 wherein the air directing means comprises an air duct operatively disposed above the pressure roll to guide the moving stream of air against and around the pressure roll and above the sheet material.

4. The improved apparatus for feeding and cutting sheet material of claim 3 wherein the pressure roll is provided with air passages to guide the moving stream of air above the sheet material and between the pressure and feed rolls.

5. The improved apparatus for feeding and cutting sheet material of claim 2 wherein the feed roll is provided with air passages to guide the moving stream of air above the sheet material and between the pressure and feed rolls.

6. The improved apparatus for feeding and cutting sheet material of claim 3 wherein the pressure roll is provided with a center roll and raised pressure rings spaced across the width of the center roll, the pressure rings having an outer surface spaced from the center roll to engage the sheet material and wall portions forming air passages between the pressure rings to guide the rapidly moving stream of air around the pressure roll and above the sheet material.

7. The improved apparatus for feeding and cutting sheet material of claim 6 wherein the pressure rings comprise cylindrical members having a surface width greater than their diameter, the pressure rings spaced across the width of the center roll in a regular pattern.

8. The improved apparatus for feeding and cutting sheet material claim 1 wherein the air source means comprises a blower or fan means.

9. The improved apparatus for feeding and cutting sheet material of claim 3 wherein the air duct is provided with a plurality of air directing surfaces to guide the moving stream of air against and around the pressure roll.

10. The improved apparatus for feeding and cutting sheet material of claim 1 wherein the feeding means includes a paper chute means to direct the sheet material to the cutting means, the paper chute means having air directing surfaces to guide the moving stream of air above the sheet material.

11. An improved apparatus for feeding and cutting sheet material comprising:

a support frame with a top portion, a bottom portion, a front panel, a first side panel, a rear panel and a second side panel, the top portion forming a roll cover having an upper wall, a front wall, a first side wall, a second side wall having a port formed therein, a rear wall having a skirt panel attached thereto, the rear panel of the support frame and the skirt panel forming an entrance opening for receiving sheet material from the supply source;

a supply roll of sheet material disposed within the support frame;

feeding means disposed within the support frame proximate the roll cover for receiving the sheet material from the supply roll and for propelling the sheet material through the support frame, the feeding means including a feed roll and a pressure roll operatively disposed above the feed roll to guide the sheet material between the pressure roll and feed roll, the pressure roll having air directing means formed therein on its surface;

an air source means for generating a moving stream of air through the port formed in the second side wall of the roll cover, the walls of the roll cover directing the stream of air against and around the pressure roll and through the air directing means of the pressure roll and above the sheet material;

cutting means disposed within the support frame for cutting the sheet material to predetermined dimensions;

and exit means for removing the shaped sheet material to a handling area formed in the top portion of the support frame.

12. The improved apparatus for feeding and cutting sheet material of claim 11 wherein the pressure roll is provided with a center roll and pressure rings spaced across the width of the center roll, the pressure rings having an outer surface spaced from the center roll to engage the sheet material and wall portions forming air passages between the pressure rings to guide the rapidly moving stream of air around the pressure roll and above the sheet material.

13. The improved apparatus of this feeding and cutting sheet material of claim 11 wherein the pressure rings comprise cylindrical members having a surface width greater than their diameter.

14. An apparatus for feeding and cutting sheet material having a support frame, feeding means, cutting means and air flow means for guiding a stream of air through the support frame, said air flow means comprising:

a blower means for introducing a stream of air into the support frame;

air directing means for guiding the stream of air against a pressure roll in operative relation with the air directing means;

passages within the pressure roll to direct the airstream between the pressure roll and a feed roll operatively disposed below the pressure roll and across sheet material fed between the pressure and feed rolls; and baffle means to direct the airstream through an exit opening in the support frame.

* * * * *